United States Patent [19]

Shupe

[11] 4,201,602

[45] May 6, 1970

[54] RAIL HARDENING MACHINE AND METHOD

[75] Inventor: Charles A. Shupe, Beaconsfield, Canada

[73] Assignee: Canron Corporation, West Columbia, S.C.

[21] Appl. No.: 917,652

[22] Filed: Jun. 21, 1978

[30] Foreign Application Priority Data

Jul. 7, 1977 [GB] United Kingdom ..... 28570/77

[51] Int. Cl.[2] ..... C21D 1/78

[52] U.S. Cl. ..... 148/146; 148/130; 148/152; 266/115; 266/127

[58] Field of Search ..... 148/131, 130, 146, 152; 266/115, 119, 127; 104/7 R, 7 B, 15

[56] References Cited

U.S. PATENT DOCUMENTS

| | | | |
|---|---|---|---|
| 3,193,270 | 7/1965 | Dewez, Jr. et al. | 148/130 |
| 3,266,956 | 8/1966 | Bennewitz et al. | 148/146 |
| 3,275,481 | 9/1966 | Adams, Jr. | 148/146 |
| 4,099,996 | 7/1978 | Toleikis, Jr. | 148/146 |

FOREIGN PATENT DOCUMENTS

| | | | |
|---|---|---|---|
| 1183111 | 12/1964 | Fed. Rep. of Germany | 148/146 |

*Primary Examiner*—L. Dewayne Rutledge
*Assistant Examiner*—Peter K. Skiff
*Attorney, Agent, or Firm*—Wenderoth, Lind & Ponack

[57] ABSTRACT

A technique for heat treating the upper surface of the head of an in situ rail is disclosed. A car carrying an induction heater followed by an air quencher and then an air and water quencher is passed along the track. In this way the upper surface of the rail head passes through successive stages of heating from ambient temperature, austenization, hardening, tempering and cooling to ambient temperature thus bringing about desired hardening of the rail head. The tendency of the rail to bend concave upwardly due to this heat treatment is counteracted by applying an upward mechanical force to the rail to tend to bend the rail in the opposite direction i.e. concave downwardly. The mechanical force is applied by a lifting mechanism carried on the rail car, the lifting mechanism progressively bending the rail simultaneously with the heat treatment.

12 Claims, 2 Drawing Figures

RAIL HARDENING MACHINE AND METHOD

BACKGROUND OF THE INVENTION

This invention relates to a method and apparatus for hardening thermally the heads of steel railroad rails to increase the service life of the rails.

Techniques have previously been evolved for hardening rail heads and typical of these are the techniques disclosed in Canadian Pat. Nos. 744,688 and 888,671. In both cases the rail is heated and quenched progressively along the head by causing the rail to move axially with respect to heating and quenching devices. Because such heat treatment would cause the rail to assume a final distorted condition in which the head would have an upward concave curvature, mechanical forces are applied to the rail simultaneously with the heat treatment to bend the rail so that it has a downward concave curvature which cancels the upward concave curvature obtained on quenching.

The major drawback of these prior techniques is that they must be carried out in the workshop prior to laying the track and so a further delay in the manufacture of heat hardened rails ready for laying is provided. Furthermore, these techniques can only be used economically on new rails in view of the expense of lifting and relaying existing track.

OBJECTS OF THE INVENTION

It is a primary object to provide a technique for and an apparatus capable of hardening at least the upper surface portion of a rail head forming part of an in situ railroad.

SUMMARY OF THE INVENTION

According to the present invention there is provided a method of heat treating at least the upper surface portion of the head of a railroad rail forming part of an in situ railroad, which comprises moving sources of heating and quenching along the upper surface portion of the head to cause progressive heating and quenching along the upper surface portion, the tendency of the rail to bend concave upwardly due to this heat treatment being at least partly counteracted by simultaneously mechanically bending the rail progressively along its length in a sense tending to produce a concave downward curve.

According to another aspect of the present invention there is provided apparatus for heat treating at least the upper surface portion of the head of a railroad rail forming part of an in situ railroad, comprising carriage means movable along the track and provided with heating means and trailing quenching means disposed in alignment for progressive heating and cooling of the upper surface portion of the rail head, and mechanical lifting means also provided on the carriage means for applying upward mechanical forces to the rail in a sense tending to produce concave downward curvature of the rail.

BRIEF DESCRIPTION OF THE DRAWINGS

An embodiment of the present invention will now be described, by way of example, with reference to the accompanying drawings, in which.

DETAILED DESCRIPTION OF PREFERRED EMBODIMENT

Figure 1:
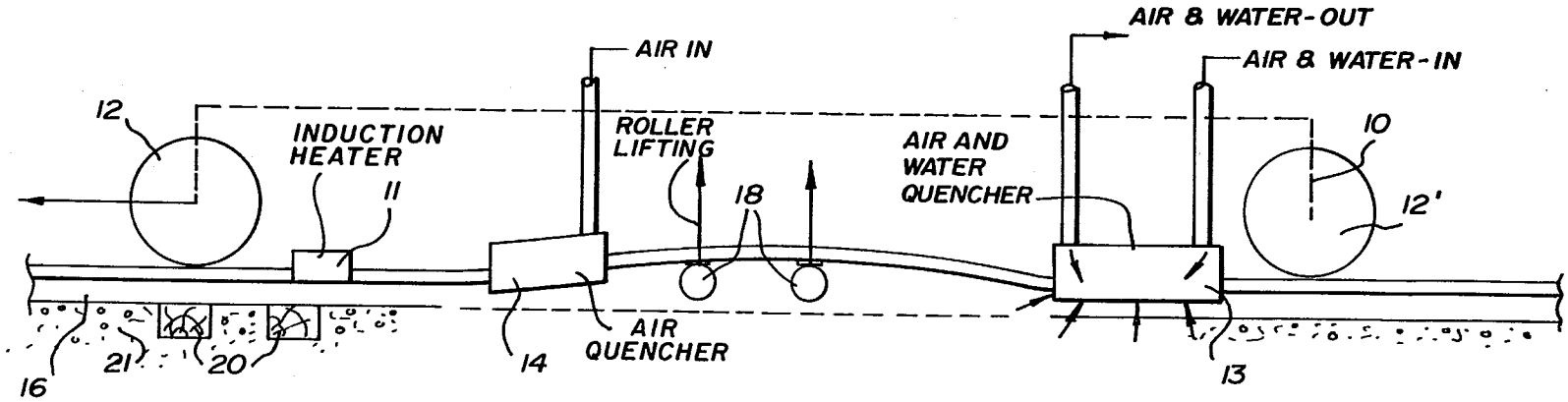
FIG. 1 is a diagrammatic view of apparatus according to the invention shown in operation on a railroad.

A self-propelled rail car 10 having a wheel base of approximately twenty feet carries an induction heater 11 near the forward wheels 12 (left hand side of the figure) of the car and an air and water quencher 13 near the rear wheels 12[1]. An air quencher 14 is located between the heater 11 and the quencher 13 but nearer the heater 11. The heater 11 and quenchers 13 and 14 are all aligned with one of the rails 16 on which the car 10 runs, it being understood that there may be provided a similar combination of heater and quenchers for the other rail.

Also carried on the car 10 is a gripping and lifting arrangement shown schematically as rollers 18 which are adapted to engage the rails 16 and bend them upwardly as the car 10 travels along the track. Such an arrangement is conventional in track raising devices and will not be described in further detail.

The quenchers 13 and 14, and the heater 11 too in alternative configurations (not shown) are independently suspended vertically to adjust to the curving of the rail. The compressed air and the water supply for the quenchers are carried on the car 10 as is the associated electrical power source and switching circuitry associated with the induction heater.

It should be clear that the rails 16 are fastened by tie plates in the conventional manner to ties 20 resting in a bed of gravel 21.

Figure 2:
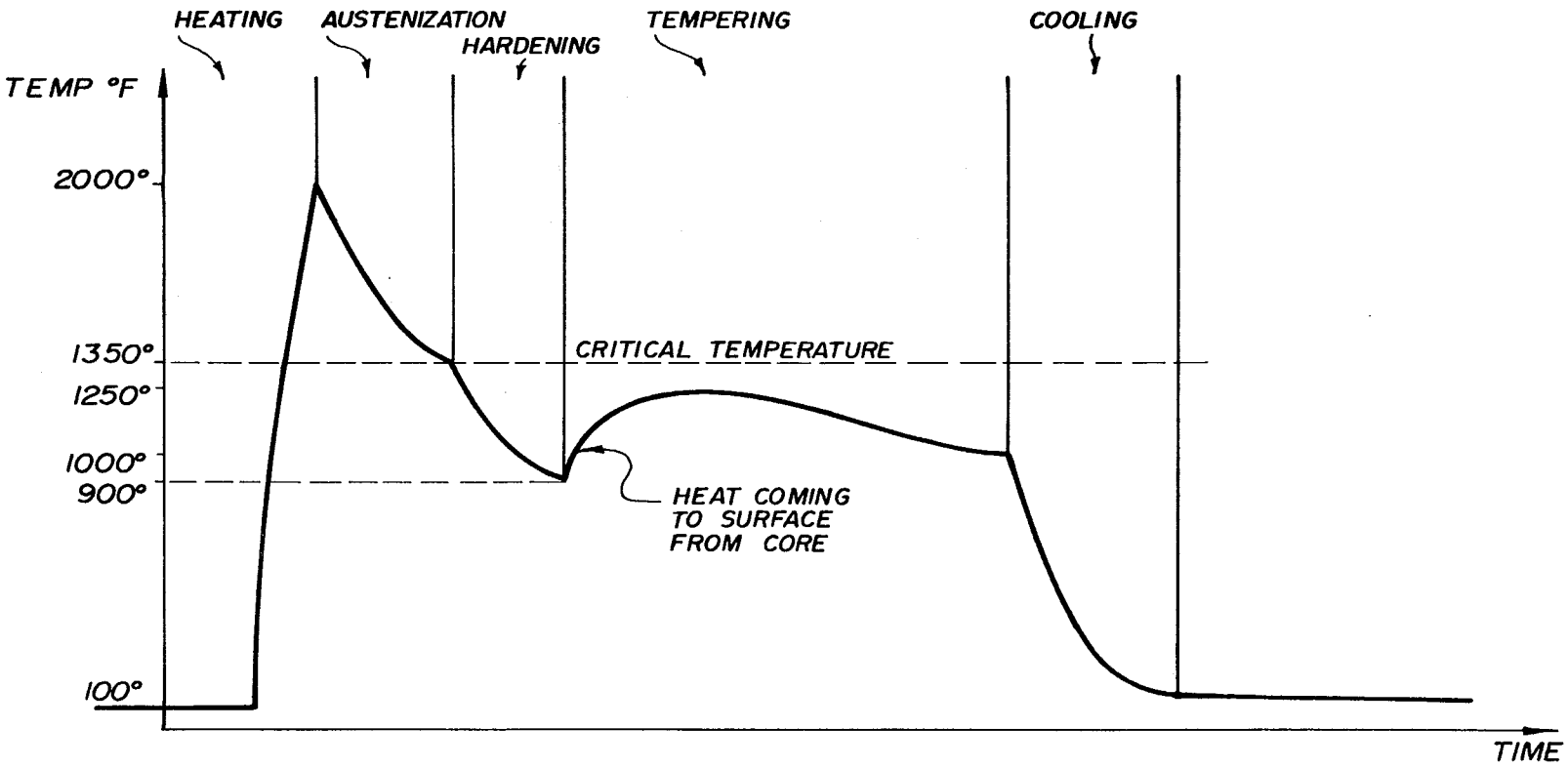
FIG. 2 is a chart showing the temperature profile of a rail over a portion which is heat treated by the apparatus of FIG. 1.

As the car 10 moves along the rails 16 in the direction indicated by the arrow at a speed of 30–40 inches per minute, the heater 11 is supplied with approximately 400 kw at 1000 HZ which causes heating of the rail head to around 2000° F. (at the surface) as indicated on the temperature profile of FIG. 2.

Austenization takes place in the time interval prior to arrival of the air quencher 14, the surface temperature dropping to around 1350° F. during this time.

On the arrival of the air quencher 14, mild quenching occurs bringing the temperature down to 900° F. and hardening the rail head.

The rail lifting rollers 18 cause the rails 16 to bulge upwardly as shown, the rail ties 20 being also raised out of the gravel bed, the maximum height of lift being around 5 inches for an effective rail length of 20 feet, i.e. the wheelbase of the car 10. Although the rollers 18 are located rearwardly of the quencher 14 bending of the rail wall, in fact occurs at all points between the wheels 12 and 12'. It is believed that the exact timing of the mechanical bending operation is not critical and thus, although this is preferably done substantially simultaneously with heating of the rail, it may be performed before or after the heating operation.

Immediately after the initial air quench the temperature of the rail head rises due to heat transfer from the core of the rail outwardly to a level of 1250° F. and then gradually tails off during the tempering stage.

Finally, at the end of tempering, the air and water quencher 13 cools the rail down to atmospheric temperature at which time the tendency for the rail to bend under the heat treatment to present an upward concave curvature has been balanced by the mechanical bending in the opposite sense so that the treated rail is virtually straight.

What I claim as my invention is:

1. A method of heat treating at least the upper surface of the head of at least one railroad rail forming part of an in situ railroad, which comprises moving along the in situ railroad a carriage runnning on the in situ railroad and having thereon heating, quenching and bending means, and operating said heating and quenching means for causing progressive heating and quenching along an upper surface portion of the head of said at least one rail, and simultaneously operating said bending means for mechanically bending the rail progressively along its length in a sense tending to produce a downwardly concave curve for at least partly counteracting the tendency of the rail to bend upwardly concave due to the heat treatment.

2. A method according to claim 1 in which the mechanical bending and the heat treatment steps are simultaneously applied to substantially the same longitudinal portions of the rail.

3. A method according to claim 1 in which the mechanical bending step is applied to immediately previously heat treated portions of the rail.

4. A method according to claim 1 in which the heat treatment steps are applied to immediately previously bent portions of the rail.

5. A method according to claim 1 in which the sources of heating and quenching are arranged to cause the upper surface portion of the rail head to pass through successive stages of heating from ambient temperature, austenization, hardening, tempering and cooling to near ambient temperature.

6. Apparatus for heat treating at least the upper surface portion of the head of a railroad rail forming part of an in situ railroad, comprising carriage means movable along the track and provided with heating means and trailing quenching means disposed in alignment for progressive heating and cooling of the upper surface portion of the rail head, and mechanical lifting means also provided on the carriage means for applying upward mechanical forces to the rail in a sense tending to produce concave downward curvature of the rail.

7. Apparatus according to claim 6 in which the heating means comprises an induction heater.

8. Apparatus according to claim 6 in which the quenching means comprises an air quencher followed by an air and water quencher spaced from the air quencher.

9. Apparatus according to claim 6, in which the heating means, quenching means and mechanical lifting means are all located between a forward pair and a rearward pair of rail engaging wheels supporting the carriage means, whereby curvature produced by the mechanical lifting means tends to occur between the two pairs of wheels.

10. Apparatus according to claim 9 in which the heating means and quenching means are adapted to conform to the curvature produced by the mechanical lifting means.

11. Apparatus according to claim 9 in which the mechanical lifting means is disposed substantially midway between the two pairs of wheels.

12. Apparatus according claim 6 in which the carriage means is provided with identical second heating means and second trailing quenching means disposed in alignment and disposed laterally of the first mentioned heating means and quenching means for progressive heating and cooling of the upper surface portion of the head of the other rail forming part of the in situ railroad, and second mechanical lifting means for applying upward mechanical forces to the other rail in a sense tending to produce concave downward curvature of the rail.

* * * * *